United States Patent [19]

Hutchison

[11] 4,128,922

[45] Dec. 12, 1978

[54] SEALING DEVICE

[76] Inventor: Charles L. Hutchison, 11 Charleston Rd., Hinsdale, Ill. 60521

[21] Appl. No.: 825,865

[22] Filed: Aug. 19, 1977

[51] Int. Cl.[2] ..... B65D 77/10

[52] U.S. Cl. ..... 24/30.5 R; 229/62

[58] Field of Search ..... 24/30.5 R, 30.5 W, 30.5 P, 24/30.5 S, 30.5 T, 30.5 L; 229/62, 63, 64, 65; 150/42, 43, 44, 45, 46

[56] References Cited

U.S. PATENT DOCUMENTS

| | | | |
|---|---|---|---|
| 2,623,665 | 12/1950 | Priamos | 229/65 |
| 3,086,264 | 4/1963 | Tindall | 229/65 |
| 3,110,070 | 11/1963 | Tremblay | 24/30.5 R |
| 3,266,711 | 8/1966 | Song | 229/62 |
| 3,503,119 | 3/1970 | Seitz et al. | 24/30.5 W |
| 3,673,640 | 7/1972 | Brown | 24/30.5 R |
| 3,864,790 | 2/1975 | Reinwall | 24/30.5 R |

*Primary Examiner*—Henry S. Jaudon

*Attorney, Agent, or Firm*—Neuman, Williams, Anderson & Olson

[57] ABSTRACT

A two piece plastic sealing device to provide a durable and permanent seal about a plastic bag or casing.

8 Claims, 3 Drawing Figures

SEALING DEVICE

BACKGROUND OF THE INVENTION

This invention relates generally to sealing devices and particularly to devices designed to provide a permanent airtight seal closing the ends of consumer meat product casings such as are used for poultry, sausages and frankfurters.

In recent years plastic bags or casings have been increasingly used for food containers and in particular for use in consumer food sales. In the packaging of meat foods such as sausages and frankfurters, for example, the meat product is packed within a tubular-like plastic casing which is then sealed at both ends. This sealing process is typically accomplished through the use of sealing clips or staples. Most of such sealing devices have been constructed of metal and are often used in automatic stapling apparatus. The problems with the use of such metal staples or clips, however, is that they will trigger and set off a false alarm if used near metal detectors which meat packers oftentimes use to insure a pure and healthy product.

Plastic devices have also been used to seal bags and the like as shown in Brenker, U.S. Pat. No. 2,951,273 and Laguerre, U.S. Pat. No. 3,002,240. These sealing devices, however, are not adequate for consumer meat products in that they are not durable and do not provide a permanent, airtight seal, as is obviously required to withstand store handling and to maintain freshness. Furthermore, these sealing devices are also relatively complex and not easily adapted for use in automated apparatus as required in high sales volume consumer goods.

It would be desirous and advantageous to have a sealing device made of plastic or some other non-metallic material which had the capability to provide a permanent, airtight seal and yet be fairly simple, economical and efficient. Preferably this device is provided with appropriate guide members so that it could easily be used with automated machinery.

SUMMARY OF THE INVENTION

The present invention provides an improved sealing device which is made of non-metallic material and at the same time provides a permanent and airtight seal which has heretofore been unavailable with similar type devices. The invention involves a two-piece plastic unit which, when the two pieces are locked together trapping a bag or casing therebetween, will assure an airtight seal by providing a double seal or redundant system of two separate sealing modes. The first sealing mode is created by the casing being entwined over and under rigid wall-like sections of the two pieces of the sealing device. The second sealing mode is established with the casing being crimped between corresponding V-shaped channels and ridges on the two sealing device pieces.

The two plastic pieces of the present invention also lock together in a tight and permanent fashion and yet the design thereof is relatively simple with integral guiding means so that the locking process may be easily automated. A series of locking tabs extend from both of the sealing pieces and after a bag or casing has been secured therebetween the tabs will be forced behind one another thereby trapping the two pieces together. Angled surfaces on the locking tabs provide a mechanical advantage and reduce the force required to bring the two pieces of the sealing device together but, due to the angle of inclination, will not allow the pieces to separate or be forced apart. Furthermore, the locking tabs are also positioned in a unique manner so as to additionally comprise part of a guide slot used to establish the proper relative positions of the two sealing pieces upon being locked together.

It is an object of the present invention to provide an improved sealing device which is totally constructed of plastic or similar non-metallic material.

It is another object of the present invention to provide a plastic sealing device which is capable of providing a durable and permanent seal about a plastic bag or casing.

It is still a further object of the present invention to provide a plastic sealing device which will effect an airtight seal at the end of a plastic bag or casing and in order to assure said airtight seal include a dual sealing arrangement.

Another object of the present invention is to provide a relatively simple sealing device with integrated guide means so that the sealing operation may be readily automated, which is inexpensive, easy to manufacture and efficient in operation.

Further objects and advantages of the present invention will become apparent as the following description, procedures, and features of novelty which characterize the invention will be pointed out with particularity in the claims annexed to and forming a part of this specification.

DESCRIPTION OF THE PREFERRED EMBODIMENT

Figure 1:
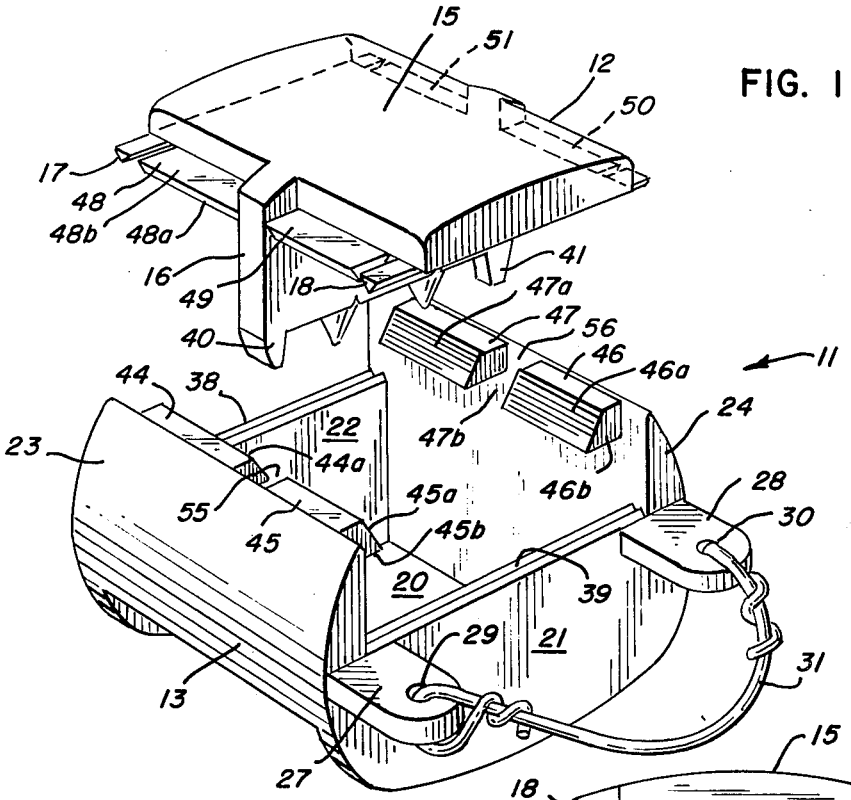
FIG. 1 is an exploded perspective view of a two-piece bag sealing device embodying the invention.

Referring now to the drawings, there is shown in FIG. 1 a two-part sealing device referred to generally by reference numeral 11. The sealing device 11 includes a generally T-shaped top member 12 and a bottom member 13. As discussed above, it is preferable that both of these members be constructed of a non-metallic material primarily so that the sealing device may be used in and about metal detectors without setting off a false alarm. The preferred embodiment of the present invention is constructed of plastic. In use, an open end of a plastic bag or casing is secured and sealed between the top member 12 and the bottom member 13 as these two members are locked together in a fashion to be described in more detail below.

The T-shaped top member 12 includes a substantially flat top portion 15 and a downwardly extending central wall 16. The wall portion 16 will act as part of a guide means for insertion of said top member 12 within the bottom member 13 so as to secure the plastic casing therebetween and will additionally act as part of the sealing means closing and forming an airtight seal about the end of the casing. Also formed on the top member 12 are two V-shaped ridges 17 and 18 which form part of a second sealing means also to be explained in more detail below.

A pair of oppositely located surrounding walls 21 and 22 are provided comprising primary components of the two separate sealing means of the invention. These two walls are very rigid and inflexible. A second pair of oppositely located surrounding walls 23 and 24 are located between and adjacent to surrounding walls 21 and 22. These walls are slightly flexible in extending above walls 21 and 22. Walls 23 and 24 further add support for the general structure of the bottom member 13 as well as facilitate the fastening and locking together of the T-shaped top member 12 and the bottom member while closing and sealing a plastic casing. The peripheral placement of the four surrounding walls, 21, 22, 23 and 24, establish a central opening 20 within the bottom member 13. There is also located on the bottom member 13, extending outwardly from wall 21, two projections 27 and 28 having apertures 29 and 30. Within and between these apertures there may be tied a string or wire 31 forming a loop to suspend the sealing device 11 and its secured casing and meat product on any type of hook for display or storage.

Figure 3:
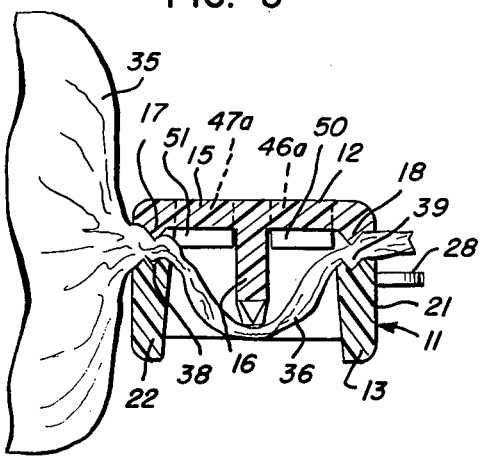
FIG. 3 is a front sectional view of the bag sealing device further showing the bag configuration while secured within said device.

As noted above, it is very important in storing food that the container be completely sealed and airtight thereby maintaining freshness. To accomplish this purpose, the sealing device of the present invention contains two separate and double or redundant sealing means in order to assure that the casing is properly closed. In sealing the casing, an open end thereof is laid across the V-shaped ridges 17 and 18 located on rigid walls 21 and 22. The T-shaped top member 12 is then pressed down on top of the bottom member 13 thereby trapping the casing therebetween. This process is best shown in FIG. 3 which shows a casing 35 containing a gathered end portion 37 entwined over the rigid wall 22, under the downwardly extending central wall 16 and over the rigid wall 21. This twisted configuration around and between the three rigid walls will secure the end 36 of the casing 35 and also effect an airtight seal. The second sealing mode is established by crimping the casing end 36 between V-shaped ridges 17 and 18 and a pair of complemental and correspondingly V-shaped grooves 38 and 39 located on top of the rigid wall portions 22 and 21, respectively. This second and double or redundant sealing means will further assure an airtight seal of the casing 35 at its gathered end 36.

Figure 2:
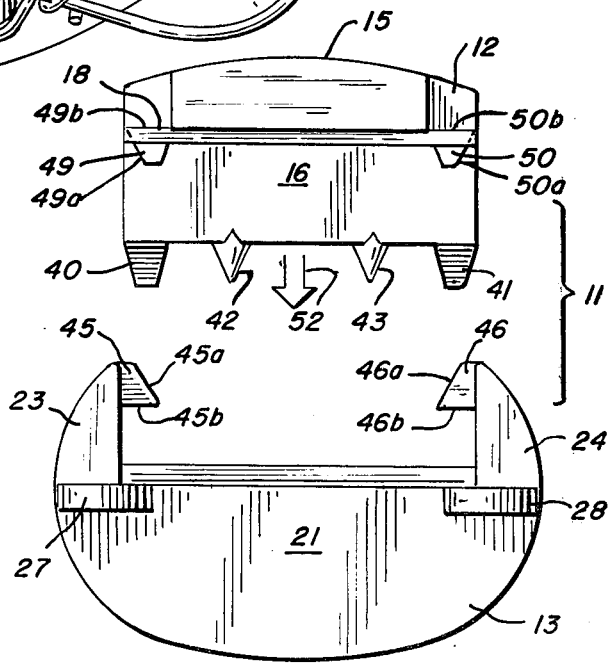
FIG. 2 is an exploded side elevational view of the bag sealing device of FIG. 1.

To eliminate the possibility of the gathered end 36 slipping out from beneath the downwardly extending central wall 16 of the first sealing means and to further facilitate the sealing operation, there are provided two perimeter downwardly extending lugs 40 and 41 which act to confine the casing end 36 therebetween. These lugs are best shown in FIG. 2. Also located on the central wall 16 are two pointed teeth members 42 and 43 which act to additionally grip and secure the bag end 36 as part of the first sealing means of the bag sealing device of the present invention. Thus, an effective and airtight seal is established by two separate and double or redundant sealing modes as a bag is secured between the top member 12 and the bottom member 13. First, the gathered end is secured and sealed by being entwined above, below and between the rigid wall members 22, 16 and 21. Secondly, this end is pinched between the V-shaped ridge members 17 and 18 and the complimental and correspondingly V-shaped grooves 38 and 39. For facilitating and providing additional effectiveness of the seal, lugs 40 and 41 act to confine the gathered bag end 36 within the grip of the first sealing mode while teeth members 42 and 43 additionally grip and secure said bag. The proper positioning of the top member 12 above the bottom member 13 for an effective seal of said bag is established in the transverse direction by the top member being secured and held between the raised sections of surrounding walls 23 and 24. Top member 12 is held in the proper lateral position by the wall portion 16 in a manner described in detail below. From these multiple and double or redundant sealing means and secured modes it is evident that an airtight seal will be assured.

For a sealing device which is to be used in the sale of consumer foods it is also necessary that such a device create a permanent and secure seal which will not be opened or torn apart during rugged processing or handling of the product. For this purpose, there is provided an array of locking tabs on the top member 12 and a corresponding array of locking tabs on the bottom member 13. These arrays act to interconnect and lock said members together. In particular, there are provided four tabs 44, 45, and 46, 47 on the inside portion of walls 23 and 24, respectively, of the bottom member 13. Corresponding locking tabs 48, 49 and 50, 51 are provided at the edges of the top portion 15 of the T-shaped top member 12. Tabs 50 and 51, although not clearly shown in the figures, are identical and oppositely located to tabs 48 and 49. Each of these tabs on the top and bottom members contain a generally inwardly facing angled surface, designated **44*a*, 45*a*, etc., and a somewhat larger horizontal surface designated generally as 44*b*, 45*b*, etc. The large horizontal surfaces of the top member tabs face toward the top and the large horizontal surfaces of the bottom member tabs face toward the bottom. As the top member 12 is pushed toward the bottom member 13 in the direction of arrow 53 shown in FIG. 2, the angled surfaces from the top member will abut and force against the angled surfaces on the bottom member thereby forcing walls 23 and 24 outward. Upon continued downward pressure on the top member 12 and outward movement of walls 23 and 24, the tabs 48 through 51 will extend between and downwardly past tabs 44 through 47 and be trapped and secured therebehind with the corresponding horizontal surfaces locking the top and bottom members together. In requiring a substantial amount of force to bend walls 23 and 24 outward, and further requiring the additional mechanical advantage of the noted angled surfaces, it is apparent that when the top member tab portions have been pushed below the bottom member tab portions, the top member 12 and the bottom member 13** will be permanently locked together.

The tab members 44 through 47 located on the bottom member 13 are uniquely positioned so that in addition to effecting the locking means they will additionally act as guide and retaining members for the wall portion 16 thereby assuring proper relative position between wall members 22, 16 and 21 of the first sealing means and proper lateral orientation of ridges 17 and 18 with respect to grooves 38 and 39 for the second sealing means. In particular, tab members 44 and 45 and tab members 46 and 47 are spaced apart a distance approximately equal to the width of the wall portion 16 thereby producing guide slots 55 and 56. In this manner, when the top member 12 is to be locked in engagement with bottom member 13, the central wall 16 is inserted within and guided by guide slots 55 and 56.

The relative simplicity of the plastic components comprising the invention and the guide means for assuring proper orientation and positioning of the various members, provide a sealing device which is readily adaptable for use with modern automated machinery. Furthermore, the new and improved sealing device of the present invention overcomes the drawbacks of using a metal sealing clip and yet still provides a strong, permanent and airtight seal.

While there has been shown and described a particular embodiment of the present invention, it will be apparent to those skilled in the art that various modifications may be made without departing from the invention in its broader aspects. It is, therefore, contemplated by the appended claims to cover all such changes and modifications as fall within the true spirit and scope of the present invention.

What is claimed as new and desired to be secured by Letters Patent of the United States is:

1. A sealing device to close the open end of a bag or casing comprising: a first non-metallic member having a top portion and a rigid downwardly extending central portion; a second non-metallic member containing at least two parallel rigid side walls; means for guiding and receiving said central portion of said first non-metallic member within an opening in said second non-metallic member; said central portion received and positioned within said opening between and parallel to said two rigid walls thereby forming a first sealing means wherein said casing is secured and sealed below said central portion and above said side walls; locking means for permanently attaching said first non-metallic member to said second non-metallic member while securing said casing therebetween wherein said locking means comprises a series of tabs formed on said first non-metallic member and a corresponding series of tabs formed on said second non-metallic member; each of said tabs containing an angled surface and an adjacent outwardly extending horizontal surface; said angled surface of each tab on said first non-metallic member being at the same inclination and abutting the angled surface of a corresponding tab on said second non-metallic member while said first and second non-metallic members are in the process of being secured together; and said first non-metallic member and said second non-metallic member being permanently locked together when the horizontal surface of a tab on said first non-metallic member is trapped behind and abutted against the horizontal surface of a corresponding tab on said second non-metallic member.

2. A sealing device to close the open end of a bag or casing comprising: a first non-metallic member having a top portion and a rigid donwardly extending central portion; a second non-metallic member containing at least two parallel rigid side walls; means for guiding and receiving said central portion of said first non-metallic member within an opening in said second non-metallic member said central portion received and positioned within said opening between and parallel to said two rigid walls thereby forming a first sealing means wherein said casing is secured and sealed below said central portion and above said side walls; locking means for permanently attaching said first non-metallic member to said second non-metallic member while securing said casing therebetween wherein said means for guiding and receiving said central portion of said first non-metallic member comprises at least two of said series of tabs on said second non-metallic member spaced apart at a distance approximately equal to the width of said central portion.

3. A sealing device to close the open end of a bag or casing comprising: a first non-metallic member having a top portion and a rigid downwardly extending central portion; a second non-metallic member containing at least two parallel rigid side walls; means for guiding and receiving said central portion of said first non-metallic member within an opening in said second non-metallic member; said central portion received and positioned within said opening between and parallel to said two rigid walls thereby forming a first sealing means wherein said casing is secured and sealed below said central portion and above said side walls; locking means for permanently attaching said first non-metallic member to said second non-metallic member while securing said casing therebetween; and further comprising a second sealing means.

4. A sealing device as claimed in claim 3 wherein said second sealing means comprises at least one generally V-shaped extension down from said top portion of said first non-metallic member and a corresponding V-shaped channel on the top of at least one of said rigid side walls; said V-shaped extension being above and along said corresponding V-shaped channel when said first non-metallic member is attached to said second non-metallic member thereby securing and sealing said bag therebetween.

5. A sealing device to close the open end of a bag or casing comprising: a first non-metallic member having a top portion and a rigid downwardly extending central portion; a second non-metallic member containing at least two parallel rigid side walls; means for guiding and receiving said central portion of said first non-metallic member within an opening in said second non-metallic member; said central portion received and positioned within said opening between and parallel to said two rigid walls thereby forming a first sealing means wherein said casing is secured and sealed below said central portion and above said side walls; locking means for permanently attaching said first non-metallic member to said second non-metallic member while securing said casing therebetween; and hanging means used for suspending said sealing device and secured bag; said hanging means comprising two projections extending out from one end of said first or second non-metallic members; and apertures formed in said projections for receiving the ends of a string or wire to which said string or wire can be tied forming a hanging loop.

6. A sealing device to close the open end of a bag or casing comprising: a first non-metallic member having a top portion and a rigid downwardly extending central portion; a second non-metallic member containing at least two parallel rigid side walls; means for guiding and receiving said central portion of said first non-metallic member within an opening in said second non-metallic member; said central portion received and positioned within said opening between and parallel to said two rigid walls thereby forming a first sealing means wherein said casing is secured and sealed below said central portion and above said side walls; locking means for permanently attaching said first non-metallic member to said second non-metallic member while securing said casing therebetween; gathering means for confining said bag within said first sealing means; said gathering means comprising two downwardly extending lugs on opposite ends of said central portion whereby said bag will be confined within said two lugs.

7. A sealing member as claimed in claim 6 including at least one pointed tooth member extending downwardly from said central portion between said lugs for engagement with and further securing of said bag.

8. A sealing device to permanently close the open end of a bag-like consumer food product container comprising: a first plastic member having a generally T-shaped configuration with a top portion and a rigid downwardly extending central portion; a second plastic member containing two parallel rigid wall members; said central portion of said first plastic member received within an opening in said second plastic member between said two rigid walled members and positioned in parallel with said wall members thereby forming a first sealing means in which said bag may be secured and sealed by being entwined under said central portion and over said two wall members; at least one generally V-shaped extension extending down from said top portion of said first plastic member and a corresponding V-shaped channel on the top of at least one said rigid wall members; said V-shaped extension positioned above said V-shaped channel as said central portion of said first plastic member is received within said opening of said second plastic member thereby forming a second sealing means between said channel and said extension within which said bag is secured; and locking means for attaching said first plastic member to said second plastic member after said central portion is received within said opening of said second plastic member.

* * * * *